United States Patent [19]

Reece et al.

[11] 4,047,063

[45] Sept. 6, 1977

[54] LIQUID METAL SLIP-RING ARRANGEMENT FOR A DYNAMO ELECTRIC MACHINE

[75] Inventors: Albert Benjamin John Reece, Stafford; Anthony John Walkden, Watford, both of England

[73] Assignee: The General Electric Company Limited, London, England

[21] Appl. No.: 675,481

[22] Filed: Apr. 9, 1976

Related U.S. Application Data

[63] Continuation of Ser. No. 532,916, Dec. 16, 1974.

[51] Int. Cl.[2] ..... H01R 39/08

[52] U.S. Cl. ..... 310/232; 310/209; 310/219

[58] Field of Search ..... 310/219, 232, 10, 40, 310/52, 227, 46, 178, 90, 191, 209; 322/48; 318/540–542

[56] References Cited

U.S. PATENT DOCUMENTS

| | | | |
|---|---|---|---|
| 3,191,082 | 6/1965 | Csillag | 310/219 |
| 3,312,843 | 4/1967 | Krulls | 310/219 |
| 3,444,408 | 5/1969 | Kruls | 310/232 |
| 3,579,006 | 5/1971 | Kindl | 310/232 |

*Primary Examiner*—R. Skudy

*Attorney, Agent, or Firm*—Kirschstein, Kirschstein, Ottinger & Frank

[57] ABSTRACT

An alternating current generator of the kind having a superconductive direct current field winding wherein: the field winding is carried on the stator; the armature winding is carried on the rotor; shaft and current collection from the armature winding is effected via a liquid metal slip-ring arrangement. The invention also provides a liquid metal slip-ring arrangement, for use with dynamo electric machines, comprising a first annular member which rotates with the machine rotor, and a non-rotating second annular member which is electrically connected to the first annular member via the liquid metal of the slip-ring arrangement, and arranged to move axially with the first annular member during axial movement of the rotor.

7 Claims, 5 Drawing Figures

LIQUID METAL SLIP-RING ARRANGEMENT FOR A DYNAMO ELECTRIC MACHINE

This is a continuation of application Ser. No. 532,916 filed Dec. 16, 1974.

This invention relates to dynamo electric machines and has two aspects.

In the first aspect the invention relates to alternating current generators of the kind incorporating a superconductive direct current field winding and at least one co-operating armature winding.

In such generators, owing to the difficulty of effecting current collection when the armature winding is carried on the rotor, the field winding is carried on the rotor and this presents the problem of providing a rotating cryostat to maintain the field winding at superconducting temperatures.

It is an object of the first aspect of the present invention to provide an alternating current generator of the kind specified wherein these difficulties are overcome.

According to the first aspect present invention, in an alternating current generator of the kind specified the field winding is carried on the stator, the armature winding is carried on the rotor shaft and current collection from the armature winding is effected via a liquid metal slip-ring arrangement.

In one particular generator in accordance with the first aspect of the invention said slip-ring arrangement comprises: a first annular member which rotates with the generator rotor in operation; and a non-rotating second annular member coaxially surrounding the first annular member, the second annular member being provided with a groove containing liquid metal in operation to which rotary motion is imparted by the first annular member so that the liquid metal is formed by centrifugal force into a pool extending around the length of the groove, into which pool the first member dips.

In another particular generator in accordance with the first aspect of the invention said slip-ring arrangement comprises: a first annular member which rotates with the generator rotor and is provided with a groove containing liquid metal in operation which is formed by centrifugal force into a pool extending around the length of the groove; and a non-rotating second annular member which dips into said pool of liquid metal.

Said second annular member is preferably mounted on a bearing support of the rotor shaft so that transverse movement of the rotor shaft is transmitted to the second member.

Said second member is also preferably arranged to move axially with said first member during axial movement of the rotor shaft.

In its second aspect the present invention relates to dynamo electric machines of the kind including a liquid metal slip-ring arrangement for the supply of current to or from a winding carried on the rotor of the machine.

With such machines difficulties with the liquid slip-ring arrangement sometimes arise due to axial movement of the rotor shaft of the machine. It is an object of the second aspect of the present invention to overcome this problem.

According to the second aspect of the present invention in a dynamo electric machine including a liquid metal slip-ring arrangement for the supply of current to or from a winding carried on the rotor of the machine, said slip-ring arrangement comprises: a first annular member which rotates with the machine rotor and non-rotating second annular member which is electrically connected to the first annular member in operation via the liquid metal of the slip-ring arrangement; said second annular member being arranged to move axially with said first member during axial movement of the rotor.

Said second annular member is suitably magnetically or mechanically coupled to the rotor for axial movement therewith.

One dynamo electric machine in accordance with the invention will now be described by way of example with reference to the accompanying drawings in which.

Figure 1:
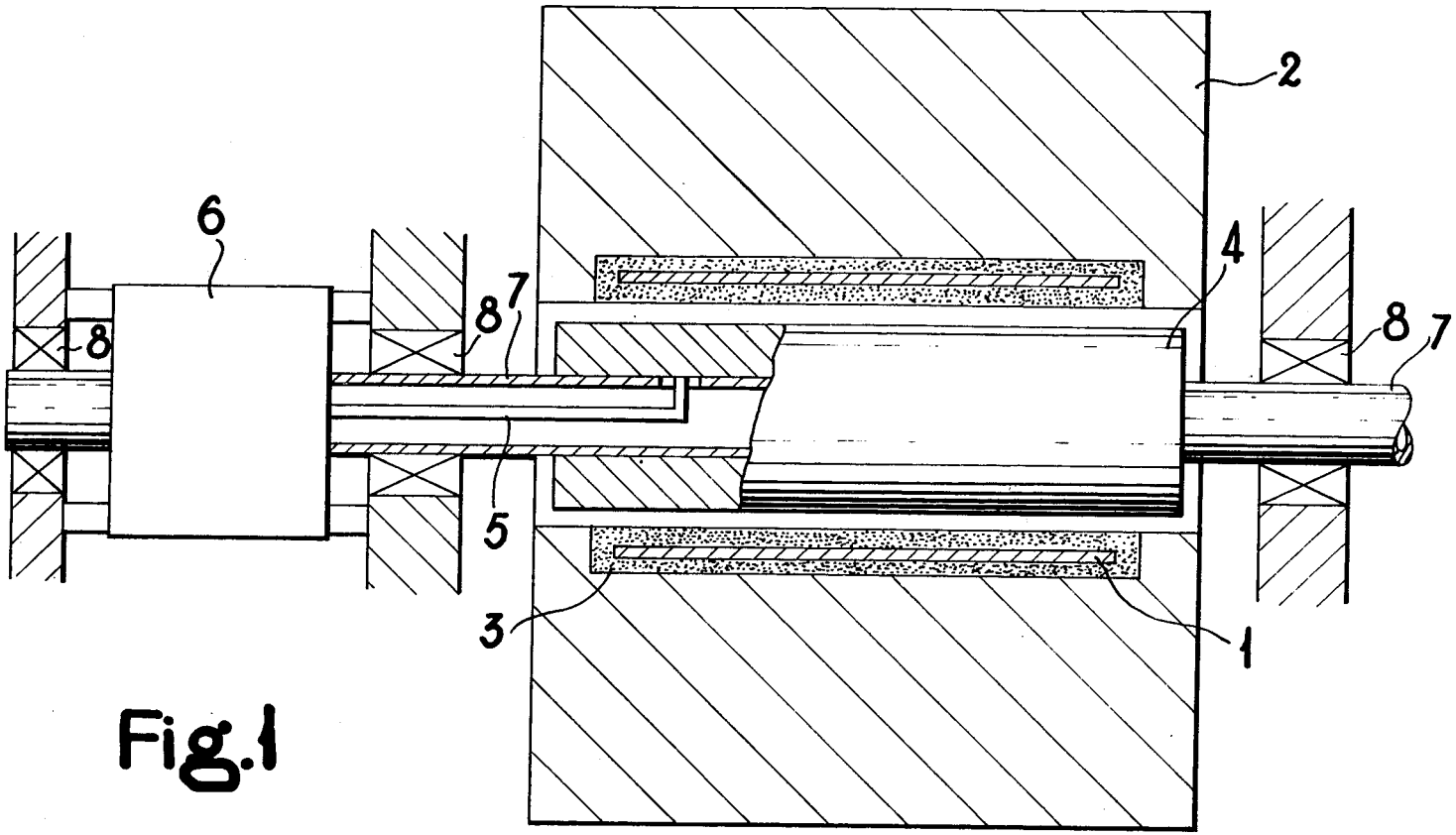
FIG. 1 shows schematically the arrangement of the machine.

Referring to FIG. 1, the machine is an alternating current generator and incorporates a superconductive direct current field winding 1 carried on the stator 2 of the generator and surrounded by a cryostat arrangement 3 of any suitable form.

The armature windings 4 of the rotor are carried on the rotor shaft of the generator and are connected via conductors 5 to a slip-ring arrangement 6, the rotor shaft 7 being hollow to allow passage of the conductors 5 and being supported in bearings 8.

Figure 2:
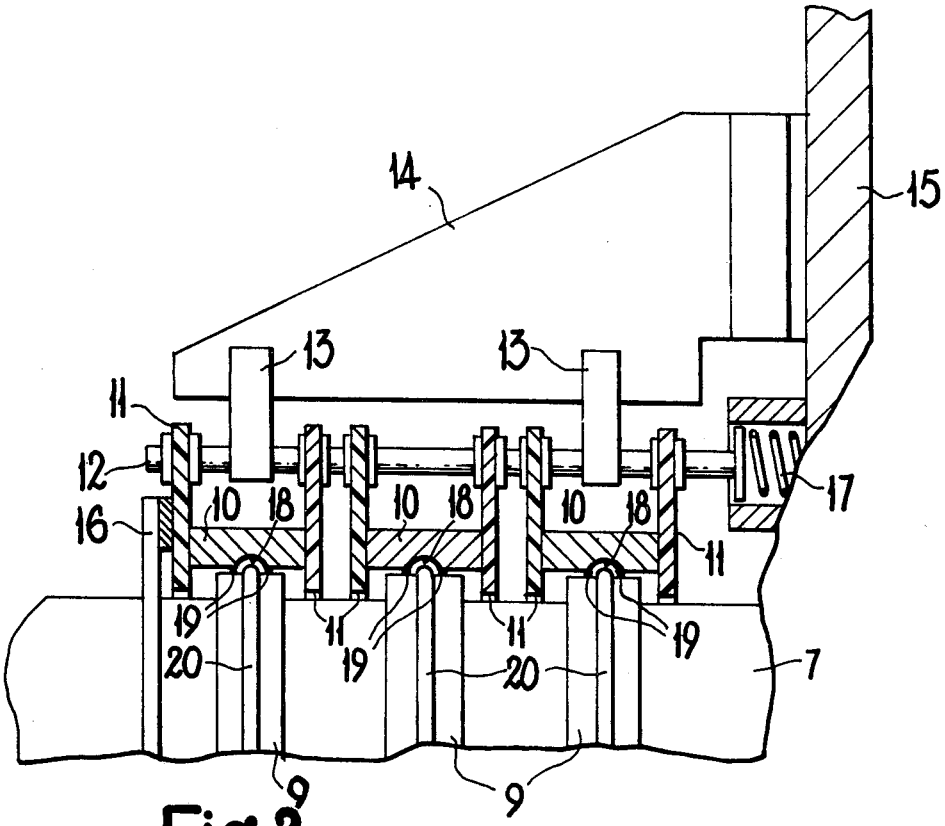
FIG. 2 is a diagram of a first slip-ring arrangement for the machine.

Referring now to FIG. 2, the slip-ring arrangement comprises three electrically insulated slip-rings 9 mounted on the rotor shaft 7 at axially spaced positions. Each slip-ring 9 is coaxially surrounded by a non-rotating annular metal ring 10 connected with an output terminal of the generator (not shown). Each of the rings 10 is supported between a respective pair of annular support members 11 of electrically insulating material, the members 11 in turn being secured to a number of metal rods 12 (one only shown in FIG. 2) which extend parallel to the rotor shaft 7 at equally spaced positions around the shaft 7.

The rods 12 are, in turn, mounted in linear bearings 13 carried by a support bracket 14 mounted on a bracket 15 carrying a bearing (not shown) for the rotor shaft 7. By this means, transverse movement (e.g. vertical movement due to thermal expansion of a bearing mounting) of the rotor shaft 7 is transmitted to the metal rings 10 so that the slip-rings 9 and metal rings 10 remain substantially coaxial during transverse movements of the rotor shaft 7.

The linear bearings 13 are provided to allow the metal rings 10 to move with the slip-rings 9 during axial movement (e.g. due to thermal expansion) of the rotor shaft 7. To this end a thrust collar 16 is provided on the rotor shaft 7 which bears against one of the insulating support members 11, the member 11 being kept in contact with the thrust collar 16 by means of return springs 17 which are mounted on the bracket 15 and act on the rods 12.

Thus the support members 11, the rods 12 and the bearings 13 constitute support means for the metal rings 10 which permits axial movement of the rings 10; and the thrust collar 16 together with support members 11 and return springs 17 constitute coupling means between the rings 10 and the rotor shaft 7 which causes the rings 10 to move axially with the slip rings 9 during axial movement of the rotor.

In operation of the generator a quantity of a liquid metal (not shown, for clarity) is supplied to the annular space between each slip-ring 9 and its associated metal ring 10, thereby to establish electrical connection between the slip-rings 9 and the generator output terminals.

To this end the internal curved surface of each ring 10 is provided with a circumferential groove 18 and seals 19 are provided on either side of each groove 18 to prevent the escape of liquid metal vapour into the spaces between adjacent slip-rings 9 and so maintain the integrity of the electrical insulation between the slip-rings 9. The seals 19 suitably comprise vanes of a resilient material such as phosphor bronze secured to the metal rings 10. The rotary motion of each slip-ring 9 in operation imparts a corresponding motion to the associated liquid metal which is consequently formed by centrifugal force into a pool extending around the whole length of the groove 18 in the associated metal ring 10. Each slip-ring 9 is provided with a circumferential projection 20 on its outer curved surface which dips into the pool of liquid metal formed in the groove 18 of the surrounding metal ring 10, thereby establishing the required electrical connections.

The space around the slip-ring arrangement is preferably pressurized with a suitable gas such as hydrogen, helium, argon or sulphur hexafluoride.

The liquid metal suitably comprises an alloy of gallium and indium, preferably containing 23% by weight of indium. The slip-rings 9 and the surrounding rings 10 suitably consist of molybdenum, iron or stainless steel.

Liquid metal is preferably continuously supplied to and extracted from the space between each slip-ring and its surrounding ring in operation by means of a liquid metal circulation system (not shown) incorporating apparatus for removing impurities from the liquid metal. Such an apparatus may conveniently be of any of the forms described in United Kingdom Patent Specification No. 1,317,478; United Kingdom Patent Applications Nos. 51375/73 and 25147/74; and United States patent application No. 445,681 filed on the Feb. 25, 1974 in the name Anthony John Walkden.

Figure 3:
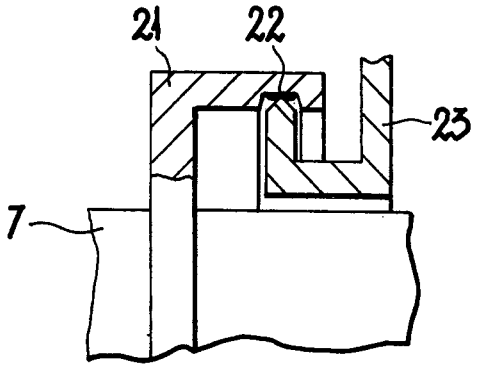
FIG. 3 is a diagram illustrating a second slip-ring arrangement for the machine.

Referring now to FIG. 3, in an alternative slip-ring arrangement which may be used in a machine in accordance with the invention, each slip-ring is constituted by a member 21 secured to the rotor shaft 7 shaped to provide an annular channel whose open side faces inwardly so that liquid metal will be formed into a pool 22 in the channel under the action of centrifugal force in operation. Current supply to the associated generator output terminal is effected via a stationary annular member 23 arranged to dip into the inward facing surface of the liquid metal pool 22.

With such an arrangement the stationary annular members 23 may be mounted in a similar manner to the rings 10 of FIG. 2 to accommodate axial and transverse movement of the rotor shaft 7. Alternatively, the members 21 and 23 may be arranged to overlap by a sufficiently large amount, as shown in FIG. 3, to accommodate axial rotor shaft movement, and the depth of the liquid metal pool 22 between the members 21 and 23 may be made large enough to accommodate transverse rotor shaft movement.

Figure 4:
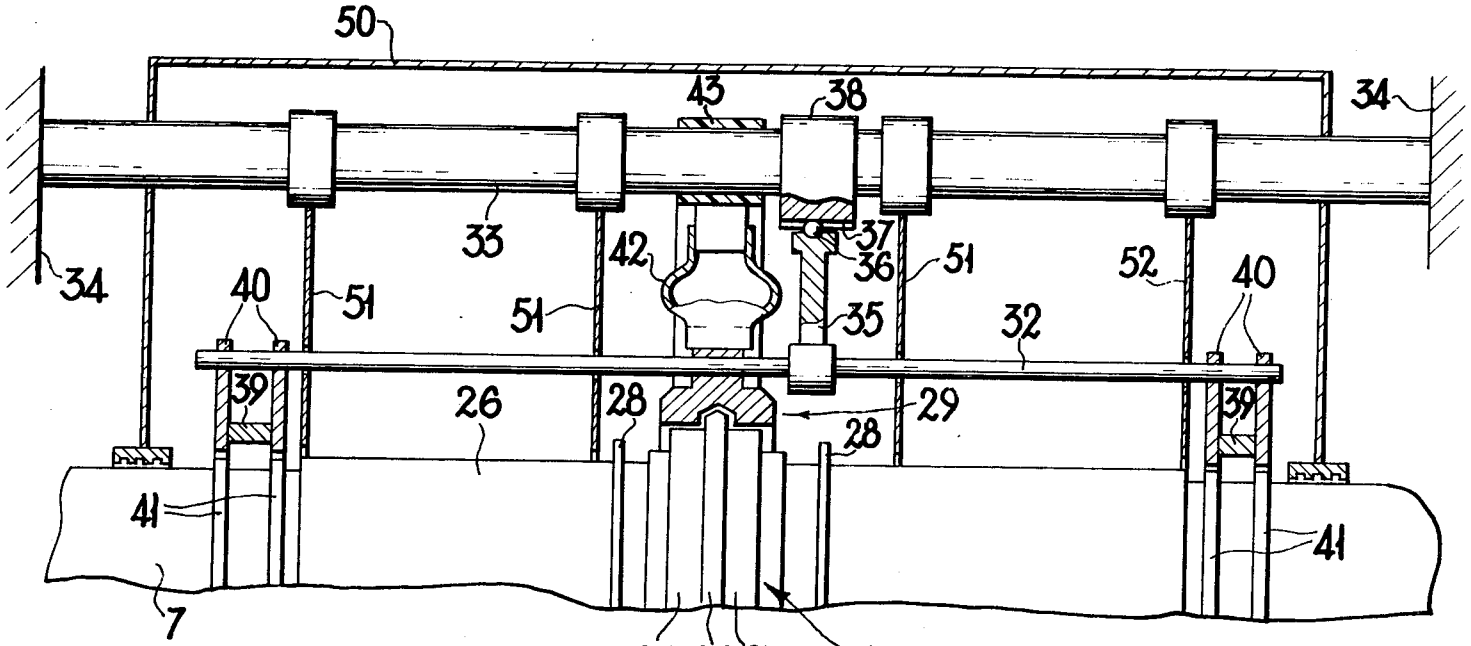
FIG. 4 is a diagram of a third slip-ring arrangement for the machine.
Figure 5:
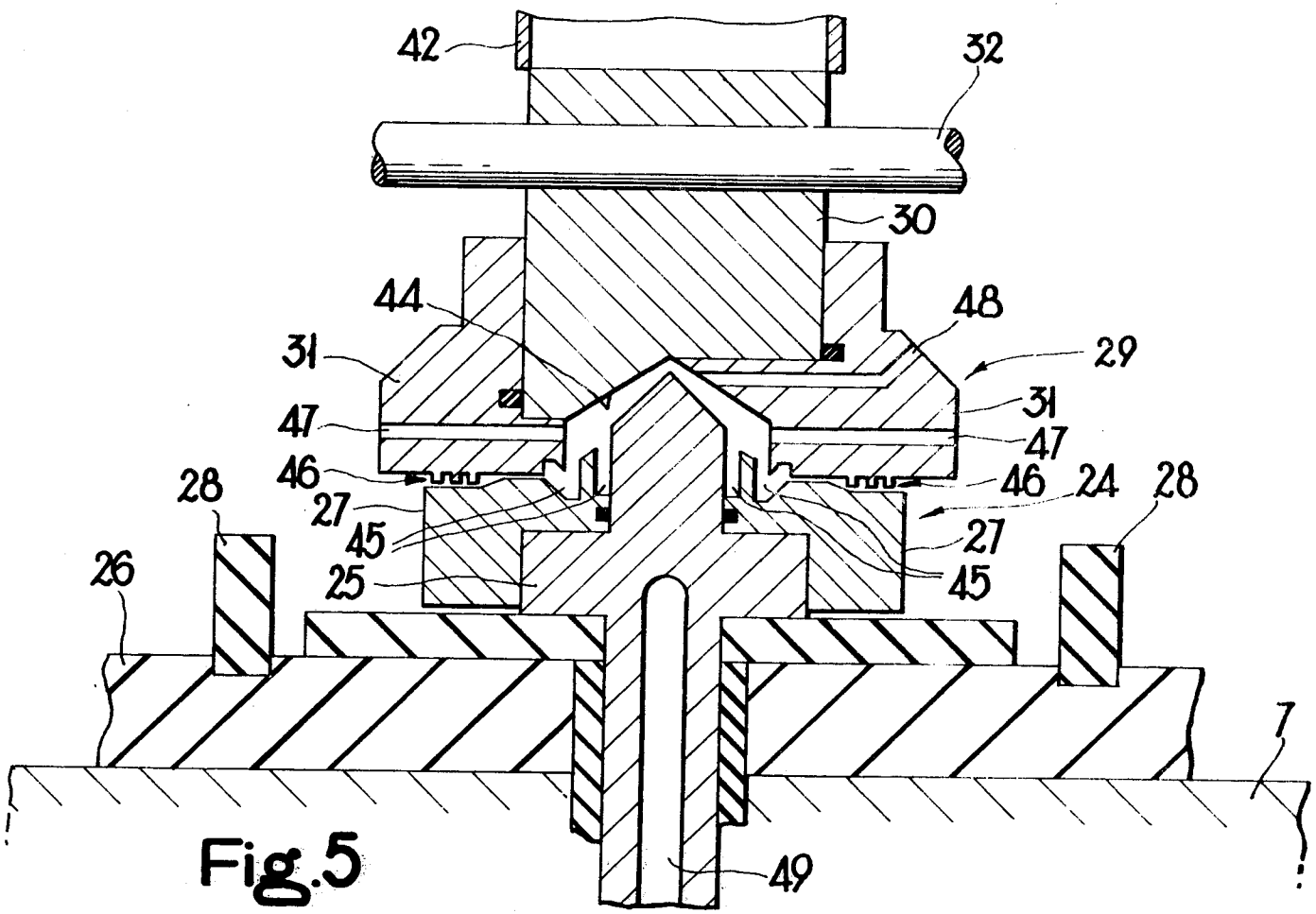
FIG. 5 is a sectional view of part of the arrangement of FIG. 4.

Referring now to FIGS. 4 and 5, in a further slip-ring arrangement which may be used in a machine in accordance with the invention each slip-ring 24 is generally of the form shown in FIG. 2 and comprises a central portion 25 which projects through a tubular insulating member 26 surrounding the rotor shaft 7 and carries on each side of it a steel collar 27. The portion 25 suitably consists of steel, molybdenum or of copper, and in the last case the part of its surface likely to contact liquid metal in operation is coated with a corrosion resistant material, for example, chromium, iron or molybdenum. Alternatively, the portion 25 may be formed mainly of copper with a molybdeum tip portion. The insulating member 26 is provided with annular projections 28 on either side of each slip-ring 24 to increase tracking resistance. In FIG. 4 only one slip-ring 24 is shown for simplicity, the other two slip-rings being positioned one on either side of the slip-ring shown.

Also as in the arrangement of FIG. 2, each slip-ring 24 is coaxially surrounded by a non-rotating annular metal ring 29 which comprises a central molybdenum, steel or coated copper central portion 30 carrying a steel collar 31 on either side.

Each ring 29 is mounted via its central portion 30 on a number of rods 32 of insulating material (one only shown in FIG. 4) which extend parallel to the rotor shaft 7 at equally spaced positions around the shaft 7. The rods 32 are, in turn, supported from an equal number of metal bars 33 which extend parallel to the rods 32, each bar 33 being supported at its ends by members 34 supporting bearings (not shown) for the rotor shaft 7. To this end, near each slip-ring 29, each rod 32 is secured to the inner end of a radial strut 35 whose outer end carries a ball bearing 36 which runs in a groove 37 formed in a member 38 secured to the corrresponding bar 33, the groove 37 extending parallel to the bar 33. The rods 32, bar 33, strut 35, bearing 36 and member 38 thus constitute support means for the rings 29 corresponding to the support means 11, 12, 13 of FIG. 2. The rods 32 are thus capable of limited axial movement to allow the rods 32, and hence the metal rings 29, to move with the slip-rings 24 during axial movement of the rotor shaft 7. The rods 32 are caused to move with the rotor shaft 7 by means of magnetic attraction between annular magnets 39 secured between annular pole-pieces 40 at each end of the rods 32 and co-operating annular pole-pieces 41 mounted on the rotor shaft 7. The magnets 39 and pole pieces 40 thus constitute magnetic coupling means corresponding to the mechanical coupling means 11, 16, 17 of FIG. 2.

Current collection from the metal rings 29 is effected by means of flexible connectors 42 extending radially between the rings 29 and rings 43 of insulating material secured to the bars 33, the outer ends of the connectors 42 being connected to terminal stalks (not shown). The number of connectors 42 is chosen according to the current rating of the generator. The connectors 42 are suitably formed from thin flexible copper sheet or copper braiding material.

The members 25, 27, 30 and 31 are internally shaped to form in a groove 44 a pool of liquid metal (not shown) into which the outer tip of the central portion 25 of the slip-ring 24 dips. Any liquid metal which drips off the sides of the groove 44 falls into recesses 45 in the collar 27 from which it is thrown back by centrifugal force into the main part of the pool.

Between the collars 27 and 31 labyrinth seals 46 are provided via which a gas is admitted under pressure in operation to carry away liquid vapour and/or mist via ducts 47 in the collars 31. Further ducts 48 are provided in the collar 31 for circulation of the liquid metal.

A cooling water duct 49 is provided in the portion 25 of the slip-ring 25 and further cooling water ducts (not shown) may be provided in the portion 30 of the ring 29.

The slip-ring arrangement is housed in a casing 50 whose interior may be pressurized with a suitable gas, and screens 51 supported from the bars 33 are provided between the individual slip-rings.

We claim:

1. A dynamo electric machine including:

A. a rotor shaft;

B. a member supporting the rotor shaft;

C. a winding carried on the rotor shaft; and

D. a liquid metal slip-ring arrangement for the supply of current to or from said winding, said slip-ring arrangement comprising:

I. a first electrically conductive annular member which is coaxial with said rotor and rotates therewith and which is electrically connected with said winding;

II. a second electrically conductive annular member;

III. support means connected between said second annular member and said member supporting the rotor shaft so as to support said second annular member coaxially with said first annular member and to provide an annular gap between said first and said second annular members, and to hold said second annular member non-rotating while permitting axial movement thereof;

IV. coupling means connected at one end to said second annular member and at its other end to the rotor shaft to cause said second annular member to move axially with said first annular member during axial movement of the rotor shaft; and V. a supply of liquid metal in said annular gap between said first and said second annular members whereby electrical connection between said members is established.

2. A machine according to claim 1 wherein said support means comprises: at least one rod whose axis extends substantially parallel to the axis of rotation of the rotor shaft and to which said second annular member is secured; and a linear bearing by which said rod is supported on said member supporting said rotor shaft for axial movement in a direction parallel to the axis of rotation of the rotor shaft; and said coupling means comprises a connection between said rod and said rotor shaft.

3. A machine according to claim 2 wherein said support means further comprises at least one radially extending strut, said rod being supported at the inner end of said strut and said linear bearing being provided at the outer end of said strut.

4. A dynamo electric machine according to claim 1 wherein said first and second annular members each comprise a central portion which carries a collar portion on either side, the collar portions being provided with ducts for circulation of the liquid metal and a gas.

5. A machine according to claim 1, the machine being an alternating current generator and further including a stator carrying a superconductive field winding, said winding carried on the rotor shaft constituting the armature winding of the machine and the slip-ring arrangement effecting current collection from the armature winding.

6. A machine according to claim 1 wherein said coupling means is a mechanical coupling means.

7. A machine according to claim 1 wherein said coupling means is a magnetic coupling means.

* * * * *